US005667039A

United States Patent [19]

Spiess

[11] Patent Number: 5,667,039

[45] Date of Patent: Sep. 16, 1997

[54] ROLLERS FOR THE ROLLER GUIDE OF SLIDING ELEVATOR DOORS

[75] Inventor: Peter Spiess, Meggen, Switzerland

[73] Assignee: Inventio AG, Hergiswil NW, Switzerland

[21] Appl. No.: 435,156

[22] Filed: May 5, 1995

[30] Foreign Application Priority Data

May 11, 1994 [EP] European Pat. Off. ..... 94107329

[51] Int. Cl.[6] ..... B66B 13/30; E05D 15/06

[52] U.S. Cl. ..... 187/334; 49/409; 160/196.1; 16/107

[58] Field of Search ..... 187/315, 324, 187/334; 49/10, 11, 409; 160/196.1, 199, 201, 206; 16/45, 91, 107

[56] References Cited

U.S. PATENT DOCUMENTS

| | | | |
|---|---|---|---|
| 923,706 | 6/1909 | Richey et al. | 49/409 X |
| 2,230,615 | 2/1941 | Dick | 16/107 X |
| 2,293,841 | 8/1942 | Long | 49/409 X |
| 2,611,920 | 9/1952 | Borden . | |
| 3,460,189 | 8/1969 | Wald et al. . | |
| 4,120,072 | 10/1978 | Hormann | 160/201 X |
| 4,588,049 | 5/1986 | Haas | 187/334 X |
| 4,642,844 | 2/1987 | Johnston . | |
| 5,165,142 | 11/1992 | Pilsbury . | |

FOREIGN PATENT DOCUMENTS

| | | |
|---|---|---|
| 0478938 | 4/1992 | European Pat. Off. . |
| 535552 | 4/1941 | United Kingdom . |

*Primary Examiner*—Karen B. Merritt
*Assistant Examiner*—Scott L. Lowe
*Attorney, Agent, or Firm*—Greenblum & Bernstein P.L.C.

[57] ABSTRACT

A roller for use in a roller guide for sliding elevator doors may include a resilient element for effecting quieter elevator operation. The resilient element may form a roller body with a bowl shaped annular casing of sheet steel to run along a carrier section including a preferably greased rail running surface. The roller body may be dimensioned such that the spring effect of the resilient element is stressed only within the elastic range or limit of the sheet steel. To obtain optimum spring effect, a radius of the rail running surface may be slightly greater than a radius of the roller body. Also, the roller body may include an open side.

12 Claims, 2 Drawing Sheets

ROLLERS FOR THE ROLLER GUIDE OF SLIDING ELEVATOR DOORS

CROSS REFERENCE TO RELATED APPLICATIONS

This application claims the priority of European Application No. EP 94107329.8, filed May 11, 1994.

BACKGROUND OF THE INVENTION

1. Field of the Invention

The present invention pertains to the construction of rollers of the runner or roller guide for a sliding elevator door, which includes resilient members for achieving greater quietness of operation.

2. Discussion of the Background of the Invention and Material Information

A roller guide for a sliding elevator door, in which the rollers include elastic inserts for the improvement of the quietness of operation is set forth in European Patent Publication EP 478 938 and cognate U.S. Pat. No. 5,165,142. These inserts consist of non-metallic, hard, elastic material. In order to avoid flat spotting of the elastic inserts, the running surfaces are relieved or unloaded in the standstill or at rest positions. This unloading occurs through roller-raising or lifting devices that are mounted laterally of the guide rail and are constructed as ramp members with a ramp and a horizontal part. The rim disks of the rollers enable a run-up onto the ramp members and a relief of the running surfaces.

In the case of a worn elastic insert, the entire roller must be replaced in this mode of construction. The softer the nature of the running surface, the better the quietness of operation, however the greater the wear of the insert. Production thereof is made more expensive due to the expense of producing the shape of the roller and the mounting of the elastic insert. Beyond that, due to the use of soft running surface inserts, the embedding of foreign materials is also made possible and impairs the quiet running thereof.

It is the task or object of this invention to construct a roller guide for a sliding elevator door of the type previously described which does not include the disadvantages thereof and which assures a high degree of quiet running in a simple manner.

SUMMARY OF THE INVENTION

This task or object is achieved in accordance with this invention in that the rollers include roller bodies, with the roller bodies themselves being of elastically yielding construction, with the actual running surfaces of the roller bodies having no spring effect in the direction of the loading. Preferably, the roller bodies are comprised of sheet steel.

A further embodiment of the rollers of this invention include a hub formed integrally with each roller body, with each hub being press fitted onto one of an axle and a rolling element bearing.

In another embodiment of the rollers of this invention, each roller body is formed as a bowl-shaped annular casing having an opening on one side thereof.

In a differing embodiment of the rollers of this invention, the running surface of each roller body is comprised of an arcuate, preferably convex, shape.

In yet a further embodiment of the rollers of this invention, the radius of the running surface of the roller body is slightly smaller than the radius of the rail running surface.

In yet another embodiment of the rollers of this invention, each roller is comprised of two roller bodies, each roller body preferably having one open side, and each roller body including a centrally elevated running surface.

The advantages achieved by this invention reside substantially in that, even in the case of continuous loading of the rollers, the resilient part thereof is stressed or loaded only within the elastic range or limit of the material of its construction. The production of the rollers is greatly simplified and reduced in cost because they are produced but of a single material. In addition, no materials subject to aging are used for achieving the desired spring effect.

The hard surface of the rollers prevents the embedding of foreign materials and thus assures greater quietness of operation. Furthermore, wear is counteracted by hard running surfaces, thereby assuring long service life of the rollers.

BRIEF DESCRIPTION OF THE DRAWINGS

The invention which will be described relative to two embodiments thereof, will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
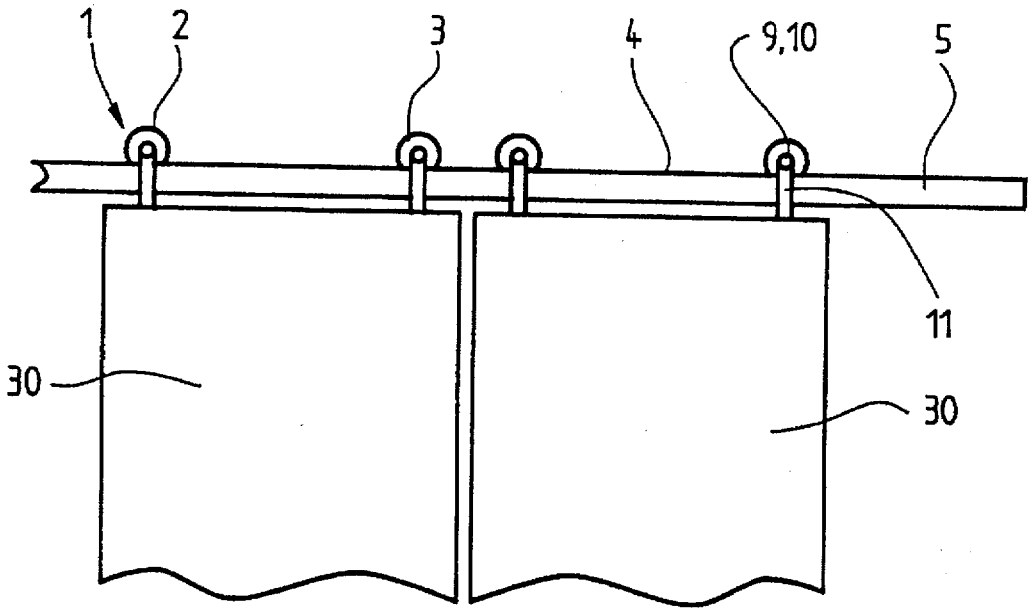
FIG. 1 is a schematic elevational view of a sliding elevator door.

FIG. 1 is a schematic sectional view of a sliding elevator door. Runners or rollers 1, comprised of roller bodies 2, having running surfaces 3, roll along on a rail running surface 4. Running surface 3 preferably has an arcuate, particularly a convex shape. In order to assure optimum guidance of runners 1, rail running surface 4 has an arcuate, particularly concave shape and is a component of a carrier section 5. Door panes 30 with suspensions or hangers 11 are connected with roller 1 via axles 10 and rolling element bearings 9 mounted thereon.

Figure 2:
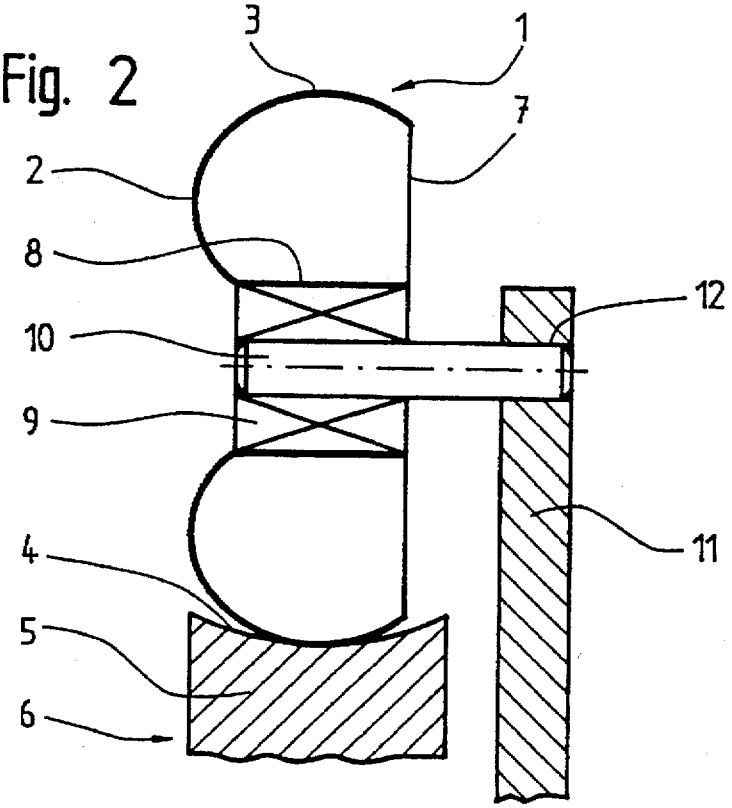
FIG. 2 is a sectional view, partly broken away, of a first example of an embodiment of a roller on a roller guide.

In FIG. 2, numeral 1 denotes a runner or roller and numeral 2 denotes a bowl-shaped annular casing, which serves as the load carrying part of roller 1. Roller body 2 is preferably comprised of thin sheet steel and the running surface 3. Running surface 3 rolls along and on the rail running surface 4 which is preferably provided with a layer of lubricating grease. Rail running surface 4 and a carrier section 5 form a guide rail 6. Roller body 2 of roller 1 is so dimensioned that the spring effect thereof is loaded or stressed only within the elastic limit or range of the sheet metal. The thickness of the sheet steel of roller body 2, depending upon the weight of the door pane (from 20 kg to about 100 kg) ranges between about 0.2 mm and 1 mm. In order to achieve an optimum spring effect, the radius of rail running surface 4 is slightly greater than the radius of running surface 3 of roller body 2. Roller body 2 has the approximate shape of a torus cut perpendicularly to the rotating axis. The open side 7, in that case, additionally simplifies the production thereof. A hub 8 of roller 1 is also formed by the annular casing so that roller body 2, running surface 3 and hub 8 represent a one-piece sheet metal part. Roller i is pressed, via hub 8, onto rolling element bearing 9. In the region of hub 8, the steel sheet is so dimensioned that a good press fit with rolling element bearing is assured, which in turn is pressed onto an axle 10.

A suspension or hanger 11 has a bore 12, at its upper end, for the insertion of axle 10, which is pressed onto or welded to suspension 11. It is also possible to press roller body 2 onto one end of axle 10 and press fit rolling element bearing 9 onto the other end of axle 10. In this case, rolling element bearing 9, pressed onto the other end of axle 10, is mounted in bore 12 of hanger 11.

Figure 3:
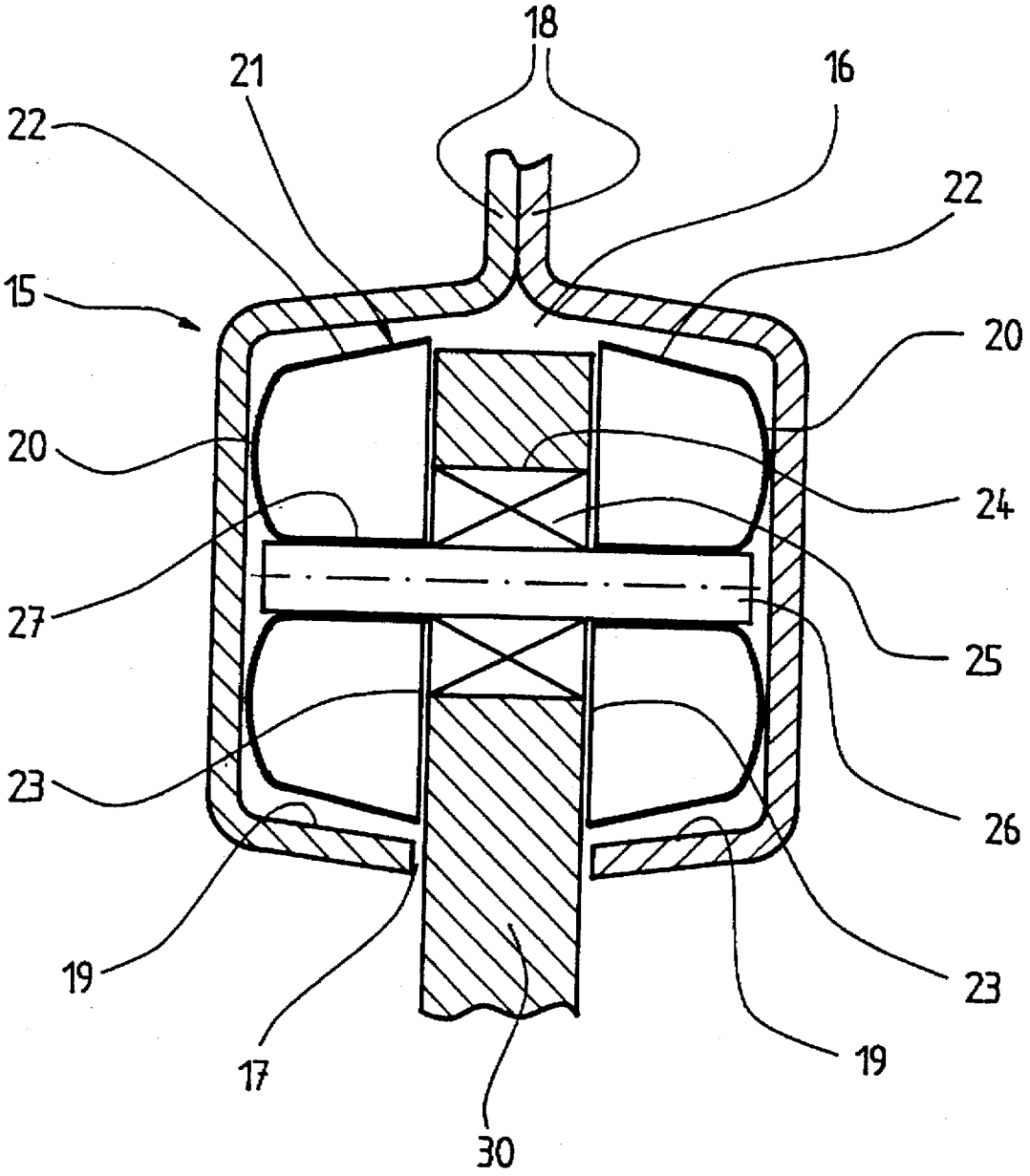
FIG. 3 is a sectional view of a second example of an embodiment of a roller on a guide.

FIG. 3 shows a second embodiment or variation in which a guide rail 15 forms a cavity 16 having a downwardly-extending, slot-shaped opening 17. Guide rail 15 is comprised of two bowl-shaped carrier sections 18 which are so bent away or shaped such that opening 17 is formed and a groove-shaped rail running surface 19 results. A runner or roller 21, comprised of two roller bodies 20, having a centrally elevated or raised running surface 22, rolls over rail running surface 19. Both of roller bodies 20 serve as the load carrying parts or portions of runners 21 and each displays a respective open side 23 in order to increase the spring effect and simplify the production thereof. An opening 24 in the door pane 30 offers space for a rolling element bearing 25 which is pressed onto an axle 26, onto which, in turn, roller bodies 20 are fastened. Roller bodies 20 each display a respective hub 27, and, after the mounting of axle 26 in pane 30, hub 27 is pressed onto axle 26. Roller bodies 20 are so arranged that their open sides 23 face each other and the centrally elevated running surface 22 is thus formed.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. Rollers in combination with a roller guide for a sliding elevator door, the rollers comprising:

roller bodies including resilient elements and actual running surfaces;

said resilient elements being of elastically yielding construction; and the actual running surfaces having no spring effect in a direction of loading.

2. The rollers of claim 1, further including a hub formed integrally with each roller body, with each hub being press fitted onto one of an axle and a rolling element bearing.

3. The rollers of claim 1, wherein the resilient elements reduce noise associated with a sliding elevator door.

4. The rollers of claim 1, wherein the roller bodies are comprised of sheet steel.

5. The rollers of claim 4, further including a hub formed integrally with each roller body, with each hub being press fitted onto one of an axle and a rolling element bearing.

6. The rollers of claim 5, wherein each roller body is formed as a bowl-shaped annular casing having an opening on one side thereof.

7. The rollers of claim 6, wherein the running surface of each roller body is comprised of an arcuate shape.

8. The rollers of claim 7, wherein each roller body is convex in shape.

9. The rollers of claim 5, wherein each roller is comprised of two roller bodies.

10. The rollers of claim 9, wherein each roller body has one open side.

11. The rollers of claim 9, wherein each roller body includes a centrally elevated running surface.

12. Rollers in combination with a roller guide for a sliding elevator door, the rollers comprising:

roller bodies including resilient elements and actual running surfaces;

said resilient elements being of elastically yielding construction: and the actual running surfaces having no spring effect in a direction of loading, wherein a radius of the actual running surface of the roller body is slightly smaller than a radius of a rail running surface.

* * * * *